US009132476B2

(12) United States Patent
Lee et al.

(10) Patent No.: US 9,132,476 B2
(45) Date of Patent: Sep. 15, 2015

(54) MULTI-WALL GAS TURBINE AIRFOIL CAST USING A CERAMIC CORE FORMED WITH A FUGITIVE INSERT AND METHOD OF MANUFACTURING SAME

(71) Applicants: Ching-Pang Lee, Cincinnati, OH (US); Gary B. Merrill, Orlando, FL (US)

(72) Inventors: Ching-Pang Lee, Cincinnati, OH (US); Gary B. Merrill, Orlando, FL (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days.

(21) Appl. No.: 14/068,061

(22) Filed: Oct. 31, 2013

(65) Prior Publication Data

US 2015/0118057 A1 Apr. 30, 2015

(51) Int. Cl.

| | |
|---|---|
| ***B22C 9/10*** | (2006.01) |
| ***B22C 9/24*** | (2006.01) |
| ***B22C 7/02*** | (2006.01) |
| ***F01D 5/18*** | (2006.01) |
| ***F01D 5/14*** | (2006.01) |

(52) U.S. Cl.

CPC ... *B22C 9/24* (2013.01); *B22C 7/02* (2013.01); *B22C 9/10* (2013.01); *F01D 5/147* (2013.01); *F01D 5/187* (2013.01); *F05D 2230/211* (2013.01)

(58) Field of Classification Search

CPC ..... B22C 9/10; B22C 9/24
USPC ..... 164/369
See application file for complete search history.

(56) References Cited

U.S. PATENT DOCUMENTS

| | | | | |
|---|---|---|---|---|
| 5,975,850 | A | 11/1999 | Abuaf et al. | |
| 6,350,404 | B1 | 2/2002 | Li et al. | |
| 6,986,949 | B2 | 1/2006 | Mertins | |
| 7,172,012 | B1 * | 2/2007 | Memmen | 164/45 |
| 7,438,118 | B2 * | 10/2008 | Santeler | 164/369 |
| 7,624,787 | B2 * | 12/2009 | Lee et al. | 164/516 |
| 8,186,965 | B2 * | 5/2012 | Kuhne et al. | 416/228 |
| 2011/0094698 | A1 | 4/2011 | Grunstra | |
| 2013/0220571 | A1 * | 8/2013 | Mueller et al. | 164/44 |
| 2013/0280092 | A1 | 10/2013 | Xu | |

* cited by examiner

*Primary Examiner* — Kevin P Kerns

(57) ABSTRACT

A multi-wall gas turbine airfoil (192) and method of forming same using a casting core (150) having a monolithic body configured to define a pressure side wall (12), a suction side wall (14), and a third wall (16). The casting core is formed around a fugitive insert (96) during a single pour casting process.

7 Claims, 11 Drawing Sheets

MULTI-WALL GAS TURBINE AIRFOIL CAST USING A CERAMIC CORE FORMED WITH A FUGITIVE INSERT AND METHOD OF MANUFACTURING SAME

FIELD OF THE INVENTION

The invention relates to a multi-wall, gas turbine engine airfoil formed via a casting operation using a monolithic casting core.

BACKGROUND OF THE INVENTION

Gas turbine engine airfoils are often conventionally formed around a casting core during an investment casting process. In order to form an airfoil with multiple walls, two or more casting cores are separately formed and then secured so they form a two-piece core assembly suitable for use in the investment casting process. However, this process may result in airfoil walls that do not meet dimensional tolerances due to mismatch during the assembly of the casting cores, due to relative movement of the casting cores during the casting process, and due to the two-piece core assembly shifting in-place during the casting process. Consequently, there remains room in the art for improvement.

BRIEF DESCRIPTION OF THE DRAWINGS

The invention is explained in the following description in view of the drawings that show:

FIG. 13 is a schematic mean-line cross sectional view of the monolithic casting core and wax mold of FIG. 12 with an exemplary embodiment of a wax pattern there between.

FIG. 17 is a schematic mean-line cross sectional view of the monolithic casting core and the shell of FIG. 15 with an exemplary embodiment of the airfoil cast there between.

DETAILED DESCRIPTION OF THE INVENTION

The present inventors have developed a novel casting process that allows for better tolerance control of cast, multi-wall airfoils, and therefore greater yield. In addition, the innovative process allows for surface cooling features to be located on interior cooling channel surfaces where surface cooling features previously could not be formed.

Figure 1:
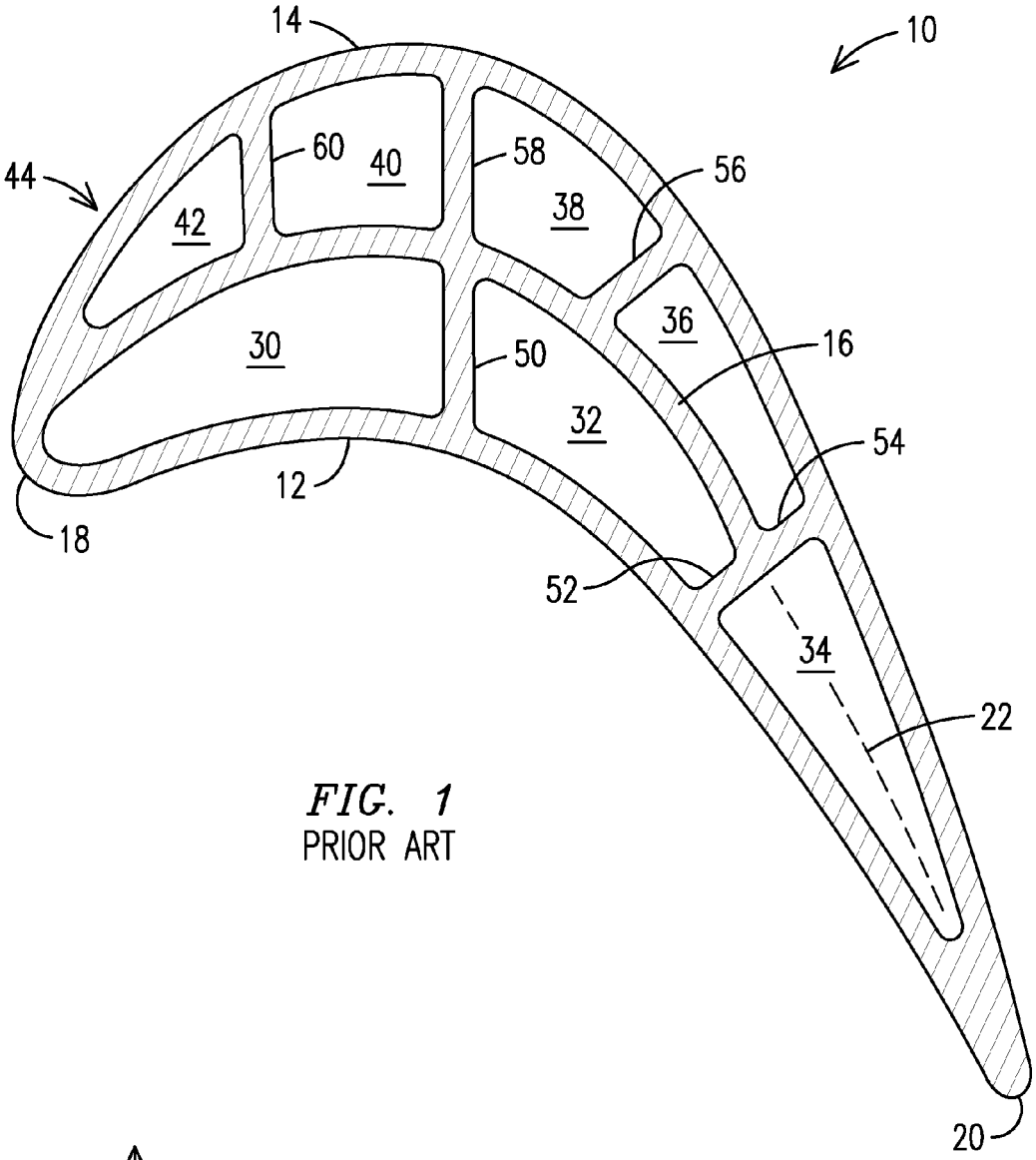
FIG. 1 PRIOR ART
FIG. 1 is a mean-line cross sectional view of an exemplary embodiment of a three-wall, seven-pass serpentine cooled airfoil.
Figure 2:
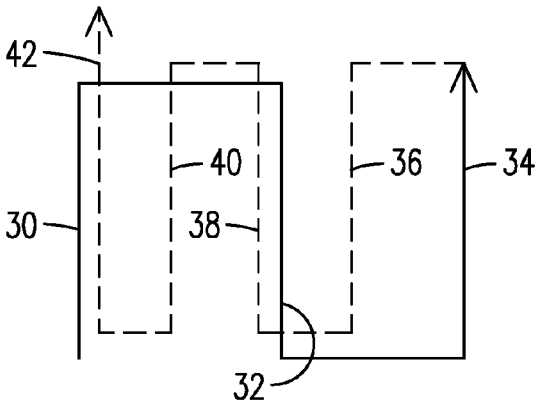
FIG. 2 is a schematic representation of the cooling circuit of the airfoil of FIG. 1.

FIG. 1 is a cross sectional view of a prior art three-wall, seven-pass serpentine cooled airfoil 10 having a pressure side wall 12, a suction side wall 14, a third (middle) wall 16, a leading edge 18, and a trailing edge 20. The third wall 16 in this exemplary embodiment loosely follows a mean line 22 of the airfoil 10. Internal cooling channels 30, 32, 34, 36, 38, 40, and 42 form a cooling circuit 44 through which a cooling medium flows during operation of the gas turbine engine. Ribs 50, 52, 54, 56, 58, 60 help define the cooling channels 30, 32, 34, 36, 38, 40, 42. A schematic representation of the cooling circuit 44 can be seen in FIG. 2.

Figure 3:
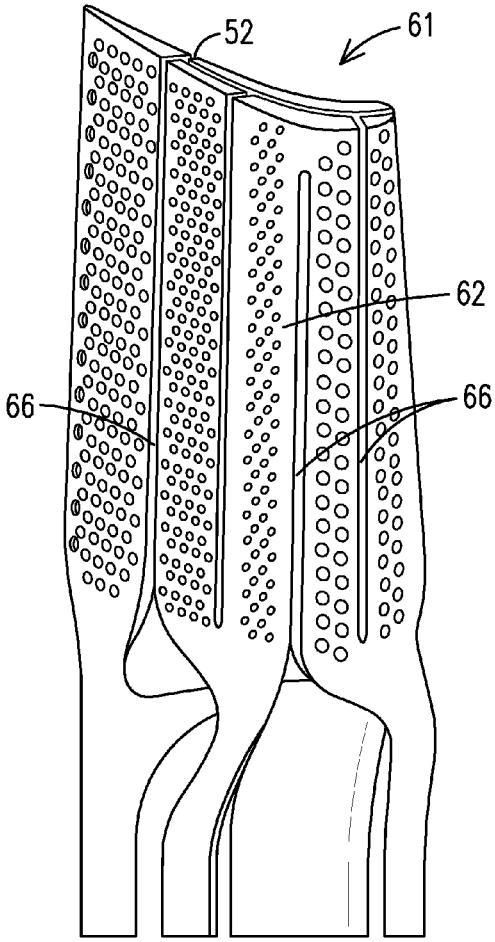
FIG. 3 PRIOR ART
FIG. 3 is a perspective view of an exemplary embodiment of a casting core used to form the airfoil of FIG. 1 looking at the suction side.
Figure 4:
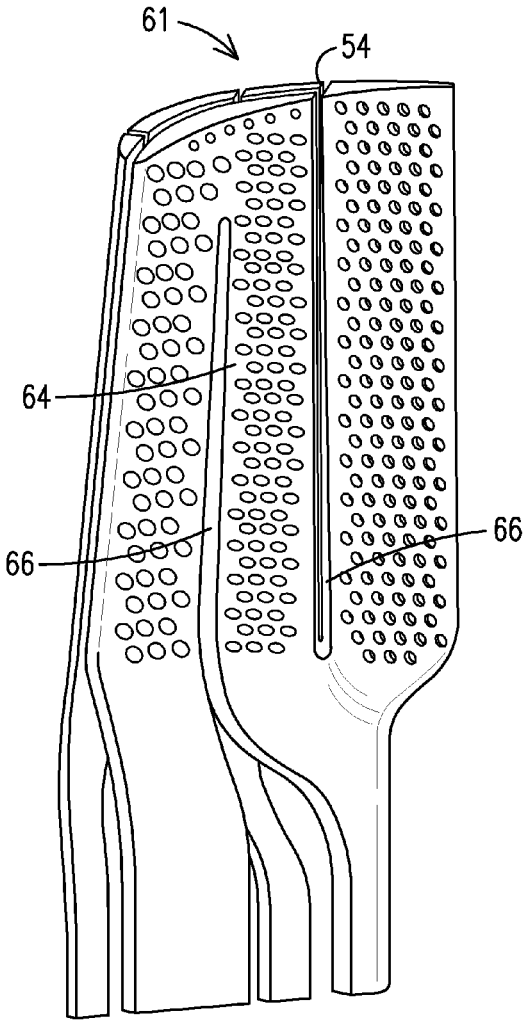
FIG. 4 PRIOR ART
FIG. 4 is a perspective view of the casting core of FIG. 3 looking at the pressure side.

FIGS. 3 and 4 are perspective views of an exemplary embodiment of a casting core assembly 61 used to form the airfoil of FIG. 1, looking at the suction side. The casting core assembly 61 is formed of a suction side casting core 62 and a pressure side casting core 64 secured together. They may be secured together in a manner known to those in the art, including using an adhesive, or by suitable positioning features that coordinate with a core mold to effect the proper positioning. Since the relative position of the casting cores 62, 64 to each other defines wall and rib thicknesses, any misalignment of the casting cores 62, 64 with each other, either during assembly or during subsequent handling, may translate into a change in a thickness of one or more walls or ribs of the airfoil 10. Often this change in thickness exceeds dimensional tolerances and results in an unacceptable part. Thus, the inventors have recognized that yield suffers because two casting cores 62, 64 are being used.

The suction side casting core 62 is formed in its own suction side core mold (not shown) and the pressure side casting core 64 is formed in its own pressure side core mold (not shown). Each casting core mold includes at least two parts that are brought together to form a cavity into which core material is cast. Portions of the casting core molds extend into the cavity to form the gaps 66 in the casting cores 62, 64. As is known in the art, in order to separate the casting core 62, 64 from its respective casting core mold, the portions of the casting core parts that form the gap 66 must be pulled (withdrawn) from the gap 66. This pulling results in the core mold parts sliding along the surface of the casting core in the gap 66. Consequently, this surface cannot have surface features that prevent this pulling of the core parts apart.

This same situation exists even if a flexible mold/liner is used. This is so because flexible molds require some room to permit flexing of the flexible mold around the surface feature. There is no room in the gap for the flexible mold to move around the surface feature. Since it is also effectively not possible to compress the flexible mold within the gap 66 such that the flexible mold could be lifted out over the surface feature located in the gap 66, any surface features in the gap 66 would be destroyed as the flexible mold is pulled from the gap 66. As a result, this potential interference makes it impossible for most cooling feature geometries to be disposed in the gaps 66. Since the gaps 66 subsequently form the ribs 50, 52, 54, 56, 58, 60, this means that the ribs 50, 52, 54, 56, 58, 60, in turn, cannot have most cooling features. This limitation restricts cooling efficiency. Thus, the inventors have recognized that cooling efficiency is restricted using the conventional practices.

In response to both limitations, the present inventors have developed a unique method that will enable production of a monolithic casting core. By using a monolithic casting core the misalignment problems disappear and with them go the associated yield losses. In addition, the unique method enables the inventors to form a wide variety of cooling features in locations of the airfoil not previously possible, thereby increasing cooling efficiency. The process incorporates the use of a flexible mold to form a fugitive insert. The fugitive insert is placed into a core mold, the core material is cast into the mold and around the fugitive insert. The fugitive insert is in the shape of the third wall of the airfoil. Thus, when the core material solidifies into a monolithic casting and the fugitive insert is removed, what remains is a monolithic casting around which a multi-wall airfoil can be cast. Using a flexible mold to form the fugitive insert permits a myriad of shapes to be formed on the surface of the fugitive insert. When the shape of the fugitive insert also includes at least part of the ribs, these surface features can also be formed on the rib-forming portion of the fugitive insert. Since the fugitive insert need not be pulled from the gaps in the monolithic casting core but is, instead, etched or melted or burned or dissolved away etc, there is no pulling action to destroy the surface features in the gap 66. As a result, the features formed on the rib-forming portion of the insert translate to the gap 66 in the core, and then to the airfoil in a manner that has not been done before to the inventors' knowledge.

Figure 5:
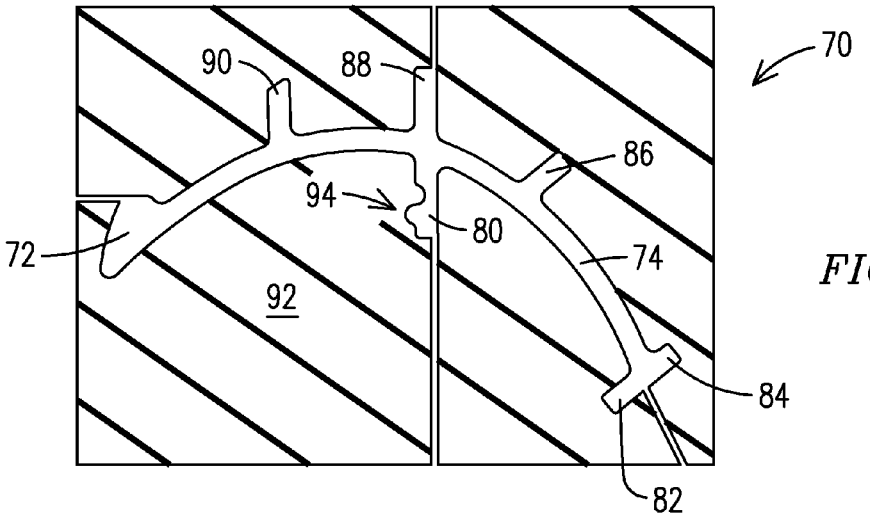
FIG. 5 is a schematic mean-line cross sectional view of an exemplary embodiment of a flexible insert mold.

FIG. 5 is a schematic mean-line cross sectional view of an exemplary embodiment of a flexible insert mold 70 having a flexible insert mold cavity 72. As used herein, a mean-line cross sectional view is a view of a plane that includes a mean-line of the airfoil. The flexible insert mold cavity 72 defines a shape of a fugitive core insert (not shown) that will be cast therein. The flexible insert mold cavity 72 includes a flexible insert mold third wall portion 74 in the shape of a third wall 16 of the airfoil, and a plurality of flexible insert mold rib portions 80, 82, 84, 86, 88, 90 in the shapes of portions or all of respective ribs 50, 52, 54, 56, 58, 60. In this exemplary embodiment, flexible insert mold section 92 includes a flexible insert mold surface feature 94 that will shape the fugitive core insert.

Figure 6:
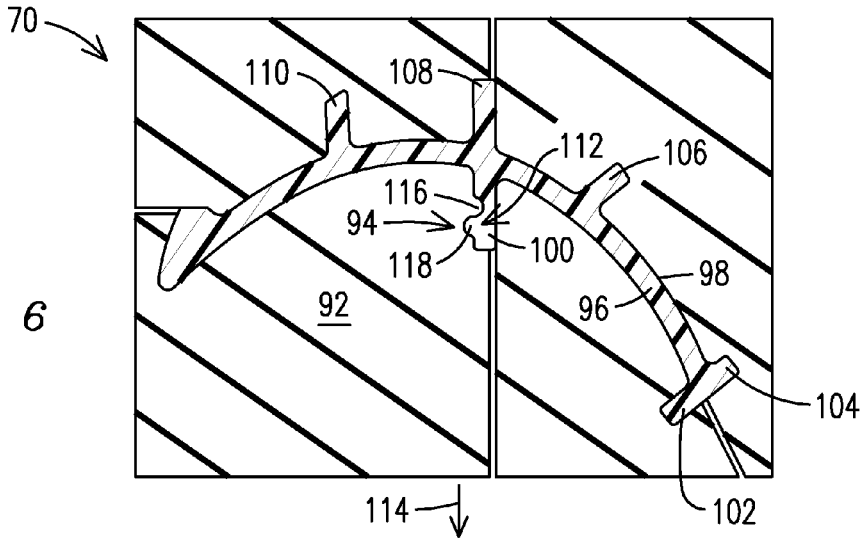
FIG. 6 is a schematic mean-line cross sectional view an exemplary embodiment of a fugitive core insert formed in the flexible insert mold of FIG. 5.

FIG. 6 is a schematic mean-line cross sectional view an exemplary embodiment of a fugitive core insert 96 formed in the flexible insert mold 70 of FIG. 5 by casting material into the flexible insert mold 70. The fugitive core insert 96 includes a fugitive core insert third wall portion 98, flexible core insert rib portions 100, 102, 104, 106, 108, 110, and a fugitive core insert rib feature 112. Once solidified, the flexible insert mold 70 is removed to reveal the fugitive core insert 96. By virtue of its flexibility, the depicted flexible insert mold or a two-piece flexible mold can be pulled from around the flexible core insert rib feature 112 even if the flexible core insert rib feature 112 would prevent a rigid two-piece core mold from being pulled apart. For example, the flexible core insert rib feature 112 may be in the shape of a dimple, recess, pattern of dimples, trip strips, protruding undercuts, negative draft angles, or any conceivable shape that would not be possible with a two-piece rigid mold. Any of these shapes would prevent a rigid two-piece mold from being pulled along a direction such as 114, because a protrusion 116 in the flexible insert mold section 92 behind (as used herein, behind means opposite in direction from a direction of movement of the mold during removal) a depression 118 in the flexible insert mold section 92 would create an interference that would prevent movement of a rigid mold in direction 114. Thus, at this step, using a flexible insert mold 70 permits the formation of surface features in a manner not possible with a rigid mold. The surface features may be formed on any of the rib portions 100, 102, 104, 106, 108, 110, or anywhere on the third wall portion 98.

Figure 7:
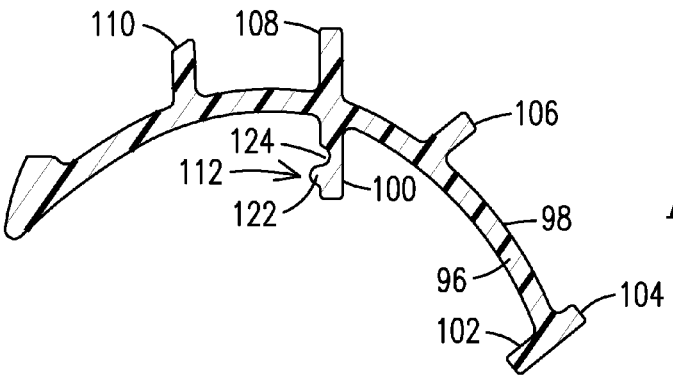
FIG. 7 is a schematic mean-line cross sectional view of the fugitive core insert of FIG. 6 removed from the flexible insert mold.

FIG. 7 is a schematic mean-line cross sectional view of the fugitive core insert 96 of FIG. 6 removed from the flexible insert mold 70. The flexible insert mold surface feature 94 formed the fugitive core insert rib feature 112 that includes a fugitive core insert protrusion 122 and a fugitive core insert depression 124. The fugitive core insert 96 may be formed of any fugitive material known to those in the art, including foam, wax, and/or plastic etc.

Figure 8:
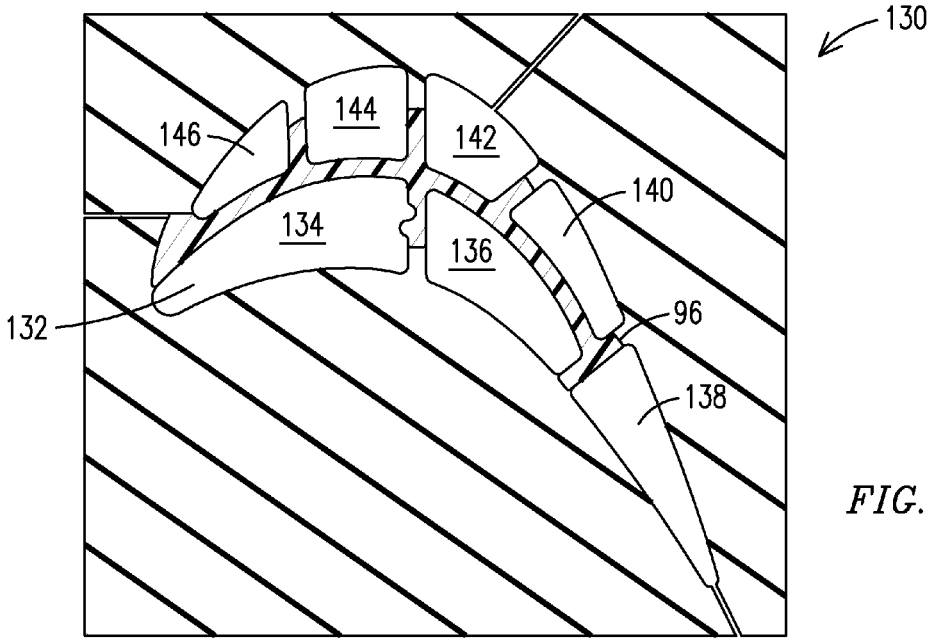
FIG. 8 is a schematic mean-line cross sectional view of the fugitive core insert of FIG. 7 as positioned in an exemplary embodiment of an airfoil core mold.

FIG. 8 is a schematic mean-line cross sectional view of the fugitive core insert 96 of FIG. 7 as positioned in an exemplary embodiment of an airfoil core mold 130. When so assembled an airfoil core mold cavity 132 is formed, which includes airfoil core mold cavity chambers 134, 136, 138, 140, 142, 144, 146, each representing a respective cooling channel 30, 32, 34, 36, 38, 40, 42.

Figure 9:
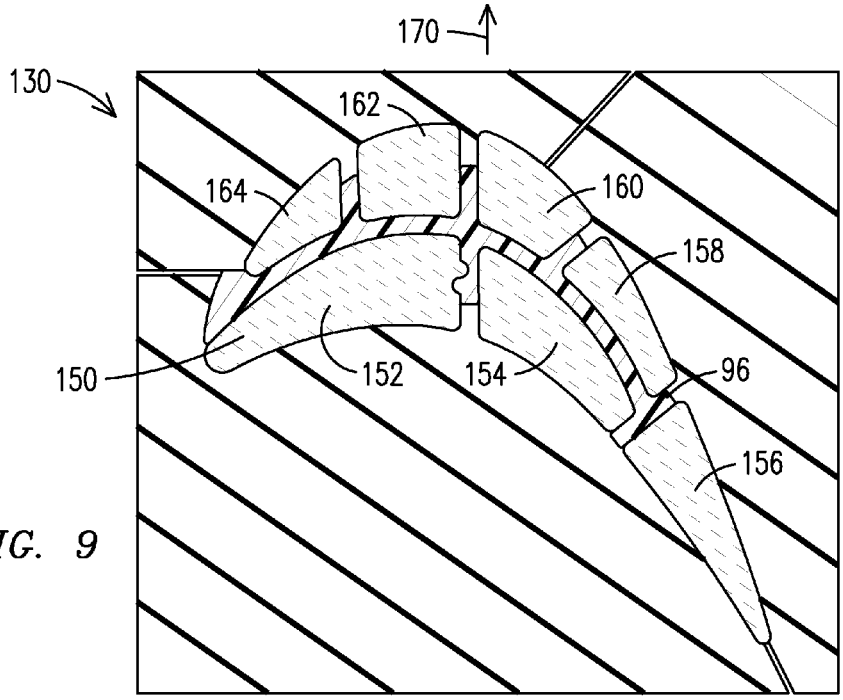
FIG. 9 is a schematic mean-line cross sectional view of an exemplary embodiment of a monolithic casting core formed around the fugitive core insert and in the airfoil core mold of FIG. 8.

FIG. 9 is a schematic mean-line cross sectional view of an exemplary embodiment of a monolithic casting core 150, (i.e. a casting core where the entire core is a single body), formed around the fugitive core insert 96 and in the airfoil core mold 130 of FIG. 8. The monolithic casting core 150 includes monolithic casting core sections 152, 154, 156, 158, 160, 162, 164, each representing a respective cooling channel 30, 32, 34, 36, 38, 40, 42. The fugitive core insert protrusion 122 and the fugitive core insert depression 124 form a monolithic casting core protrusion 166 and a monolithic casting core depression 168. It can be seen that these work together to lock the rib section 100 of the fugitive core insert 96 between the monolithic casting core sections 152 and 154. Thus, if this were the conventional process where only monolithic casting core sections 152, 154, and 156 were being formed and where the fugitive core insert 96 were a mold part, the fugitive core insert 96 would be locked into the monolithic casting core 150, regardless of whether it was a rigid or flexible mold. However, since the fugitive core insert 96 is fugitive, it can be leached, etched, or dissolved away. This eliminates the need for movement along direction 170 as would be necessary in the prior art. Consequently, it is exactly the shapes previously not possible that this method now permits. These shapes are described herein as undulations when seen in such mean-line cross section. By that it is meant that when a fugitive core insert depression 124 lies behind a fugitive core insert protrusion 122 such that it prevents movement of the fugitive core insert 96 from the monolithic casting core 150 in direction 170 (here again assuming that monolithic casting core sections 158, 160, 162, and 164 were not present for sake of this explanation), the fugitive core insert protrusion 122 and the fugitive core insert depression 124 together form an undulation 172. This undulation need not be symmetric or smooth. Any shape that results in the interlock that prevents separation of the interlocked parts qualifies as forming the undulation as meant herein.

From the foregoing it can be seen that the fugitive core insert 96 enables the formation of a new monolithic casting core 150 capable of forming a third wall 16 in an airfoil and which may also form surface features in that airfoil's rib 50, 52, 54, 56, 58, and/or 60 and/or third wall 16 previously not possible.

Figure 10:
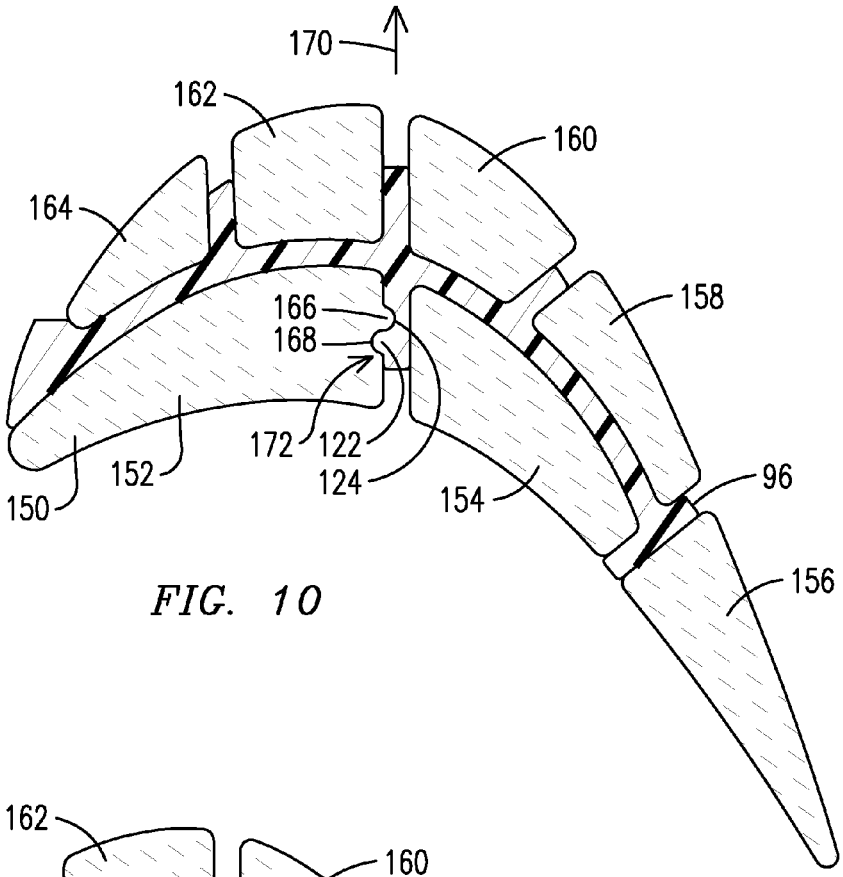
FIG. 10 is a schematic mean-line cross sectional view of the monolithic casting core and fugitive core insert of FIG. 9 removed from the airfoil core mold.
Figure 11:
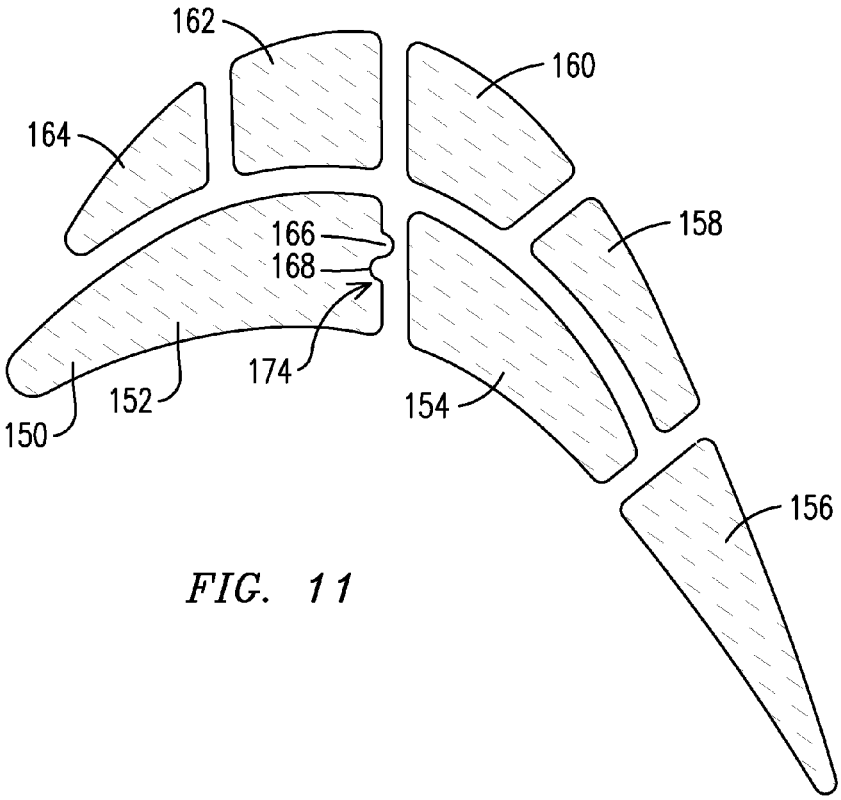
FIG. 11 is a schematic mean-line cross sectional view of the monolithic casting core of FIG. 10.

FIG. 10 is a schematic mean-line cross sectional view of the monolithic casting core 150 and the fugitive core insert 96 of FIG. 9 removed from the airfoil core mold 130. FIG. 11 is a schematic mean-line cross sectional view of the monolithic casting core 150 of FIG. 10 after the fugitive core insert 96 has been removed. Removal may be accomplished using techniques known to those in the art, such as melting, etching, leaching etc. A core surface feature 174 remains that includes the monolithic casting core protrusion 166 and the monolithic casting core depression 168. The surface feature may be understood to include both the monolithic casting core protrusion 166 and the monolithic casting core depression 168, or alternately, the monolithic casting core protrusion 166 may be considered one surface feature and the monolithic casting core depression 168 may be considered another surface feature.

Figure 12:
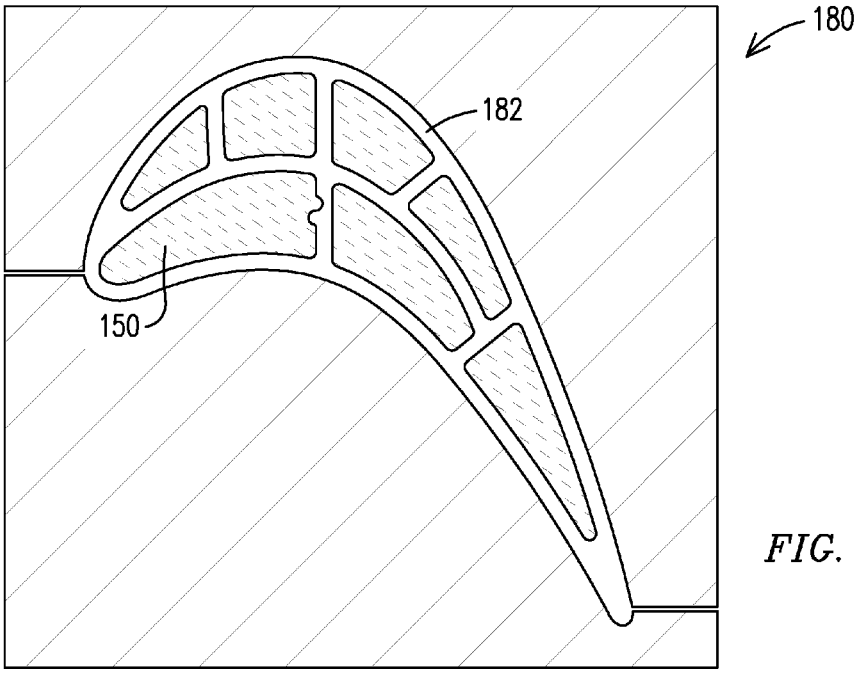
FIG. 12 is a schematic mean-line cross sectional view of the monolithic casting core of FIG. 11 positioned in an exemplary embodiment of a wax mold.
Figure 13:
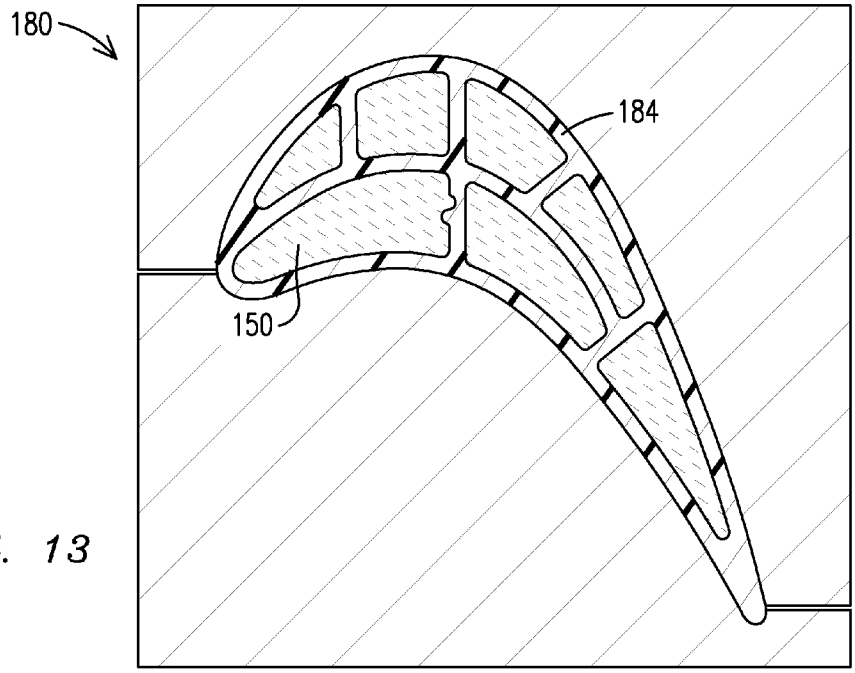
Figure 14:
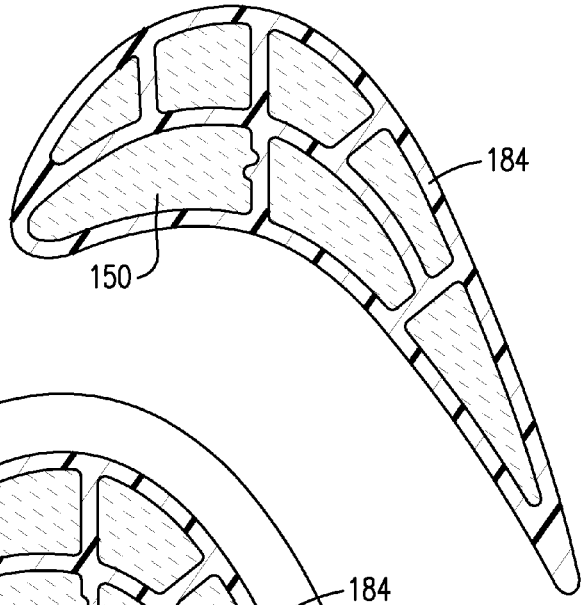
FIG. 14 is a schematic mean-line cross sectional view of the wax pattern and monolithic casting core of FIG. 13 removed from the wax mold.
Figure 15:
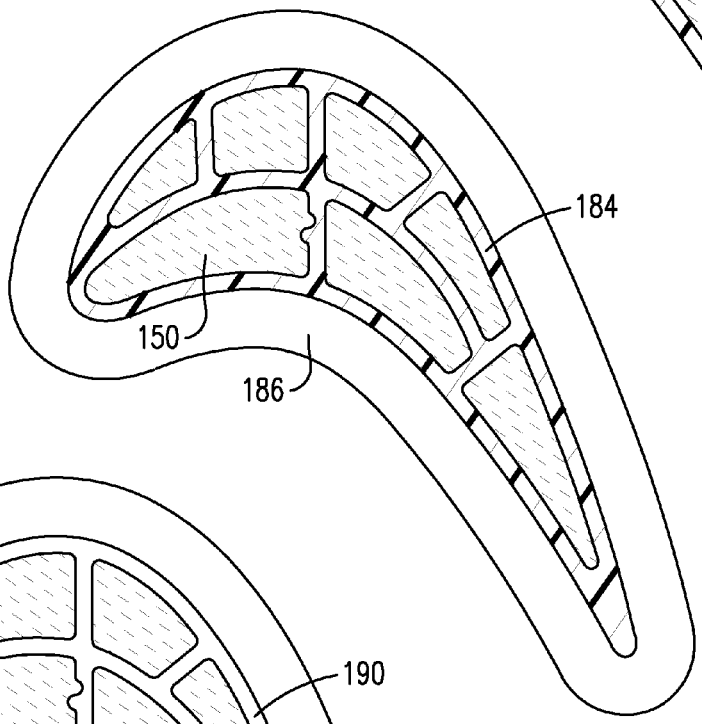
FIG. 15 is a schematic mean-line cross sectional view of the wax pattern and monolithic casting core of FIG. 14 with an exemplary embodiment of a shell formed there around.
Figure 16:
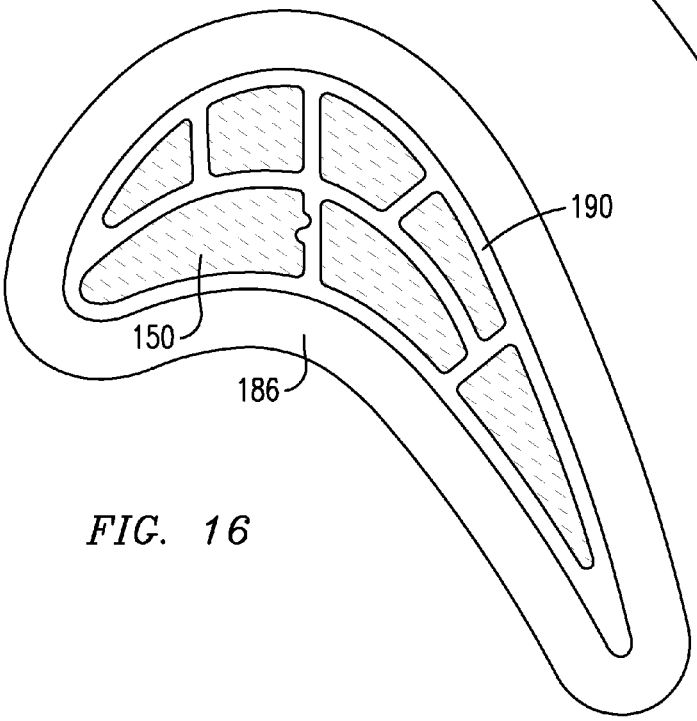
FIG. 16 is a schematic mean-line cross sectional view of the monolithic casting core and the shell of FIG. 15 with the wax pattern removed.
Figure 17:
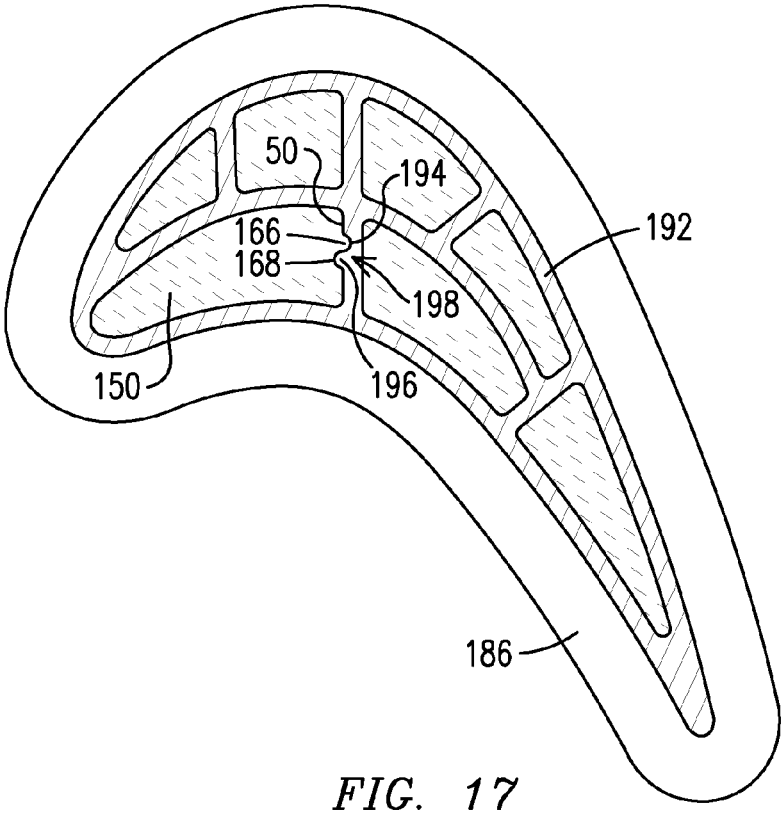
Figure 18:
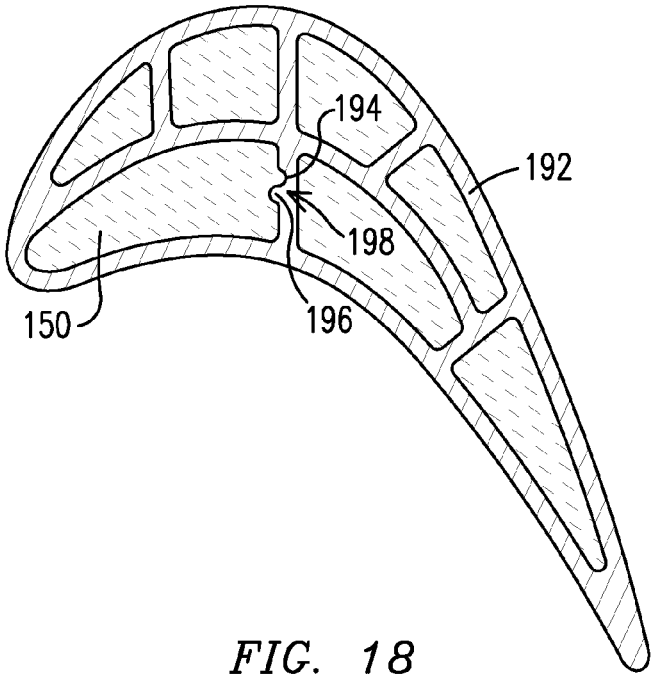
FIG. 18 is a schematic mean-line cross sectional view of the monolithic casting core and the airfoil of FIG. 17 with the shell removed.
Figure 19:
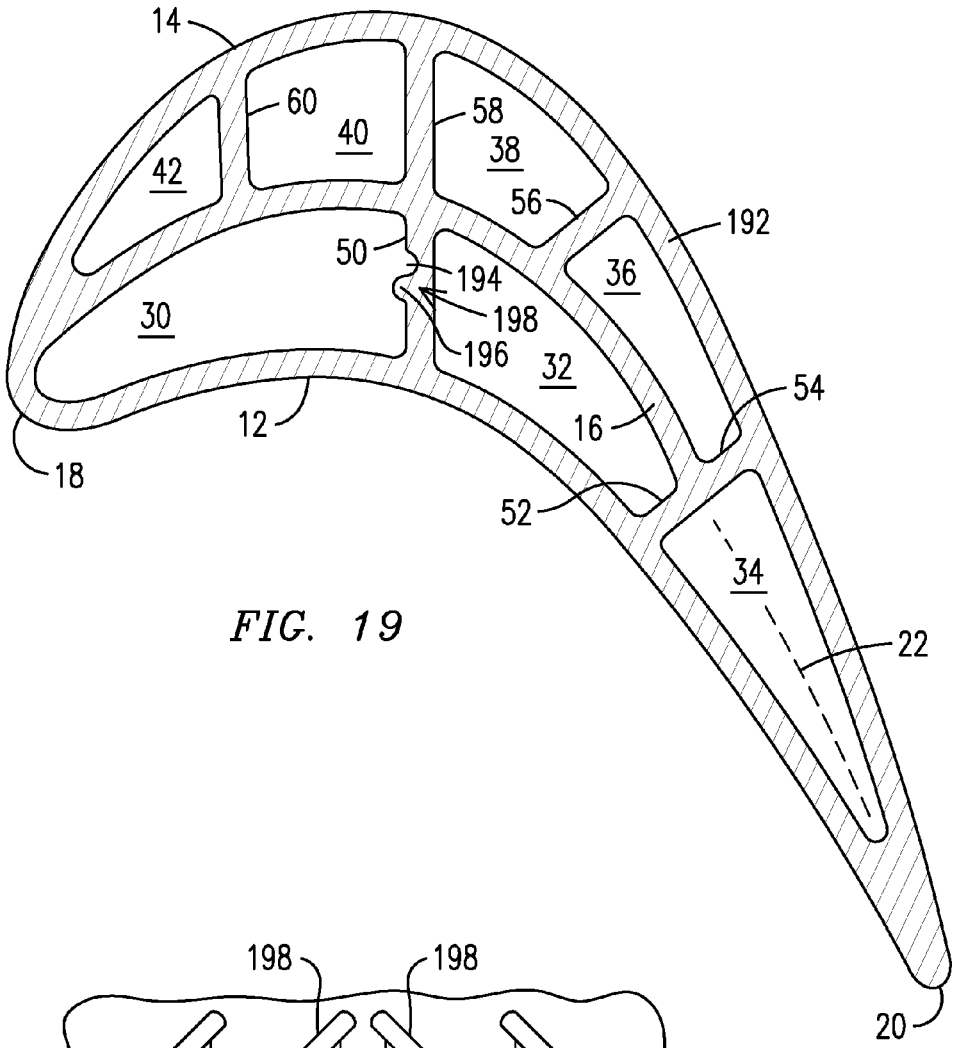
FIG. 19 is a schematic mean-line cross sectional view of the airfoil of FIG. 18 with the monolithic casting core removed.

FIGS. 12-19 depict an exemplary embodiment of the casting process used to form the airfoil. FIG. 12 is a schematic mean-line cross sectional view of the monolithic casting core 150 of FIG. 11 positioned in an exemplary embodiment of a wax mold 180 to form a wax pattern cavity 182 in which a wax pattern will be cast. FIG. 13 is a schematic mean-line cross sectional view of the monolithic casting core 150 and the wax mold 180 of FIG. 12 with an exemplary embodiment of a wax pattern 184 that has been cast there between. FIG. 14 is a schematic mean-line cross sectional view of the wax pattern 184 and monolithic casting core 150 of FIG. 13 removed from the wax mold 180. FIG. 15 is a schematic mean-line cross sectional view of the wax pattern 184 and monolithic casting core 150 of FIG. 14 with an exemplary embodiment of a shell 186 formed there around. FIG. 16 is a schematic mean-line cross sectional view of the monolithic casting core 150 and the shell 186 of FIG. 15 with the wax pattern 184 removed to form an airfoil gap 190 in which the airfoil will be cast. FIG. 17 is a schematic mean-line cross sectional view of the monolithic casting core 150 and the shell 186 of FIG. 15 with an exemplary embodiment of an airfoil 192 cast there between. The monolithic casting core protrusion 166 forms an airfoil depression 194 and the monolithic casting core depression 168 forms an airfoil protrusion 196 in rib 50. The airfoil depression 194 and the airfoil protrusion 196 together or individually form an airfoil surface feature 198. The surface feature 198 may act to increase a surface area of a cooling channel in which the surface feature 198 is disposed and/or create turbulence in a flow of coolant through the cooling channel to increase cooling efficiency. FIG. 18 is a schematic mean-line cross sectional view of the monolithic casting core 150 and the airfoil 192 of FIG. 17 with the shell 186 removed. FIG. 19 is a schematic mean-line cross sectional view of the airfoil 192 of FIG. 18 with the monolithic casting core 150 removed to expose the cooling channels 30, 32, 34, 36, 38, 40, 42 formed by the ribs 50, 52, 54, 56, 58, 60 and the surface feature 198 formed by either or both the airfoil depression 194 and the airfoil protrusion 196.

Figure 20:
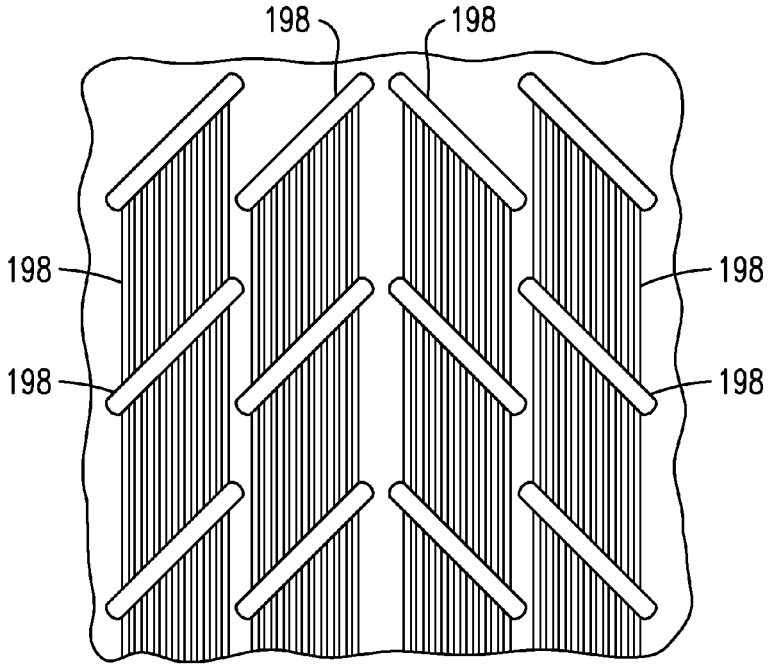
FIG. 20 is an exemplary embodiment of surface features that may be formed on the ribs of the airfoil of FIG. 19.

FIG. 20 is an exemplary embodiment of surface features 198 that may be formed on the ribs 50, 52, 54, 56, 58, 60 of the airfoil 192 of FIG. 19. However, any desired geometry may be used.

Figure 21:
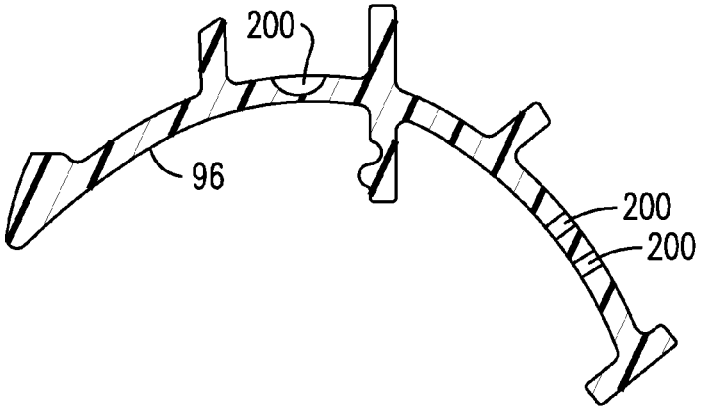
FIG. 21 is a schematic mean-line cross sectional view of an exemplary embodiment of a fugitive core insert configured to form positioning features in the monolithic casting core of FIG. 11.
Figure 22:
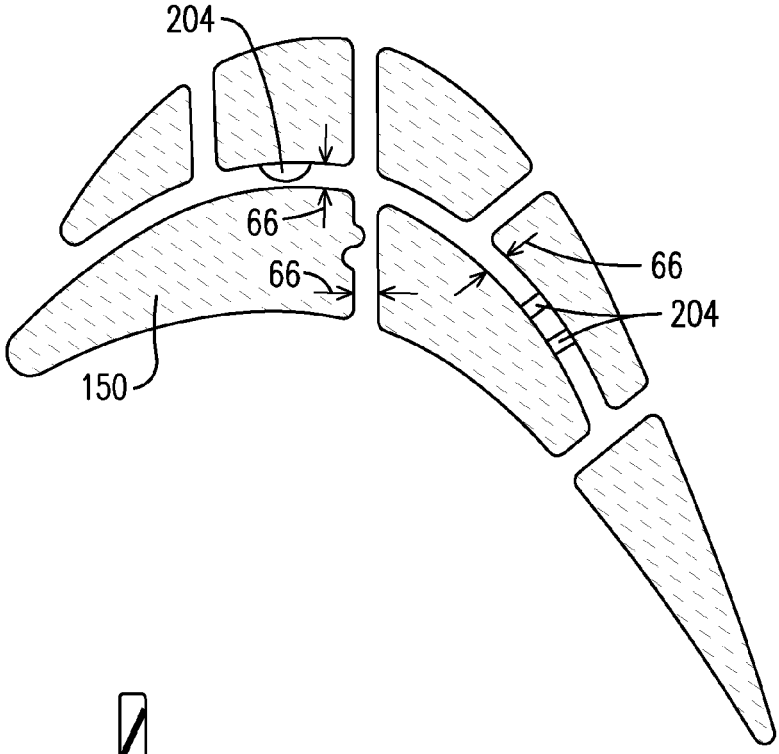
FIG. 22 is a schematic mean-line cross sectional view of an alternate exemplary embodiment of a monolithic casting core.

FIG. 21 is a schematic mean-line cross sectional view of an exemplary embodiment of a fugitive core insert 96 including fugitive core insert positioning features 200 configured to form positioning features in an alternate exemplary embodiment the monolithic casting core 202 as shown in FIG. 22. These fugitive core insert positioning features 200 form core positioning features 204 on the monolithic casting core 150 that either span or narrow the gap 66 in the monolithic casting core 150 that form the third wall 16 or ribs 50, 52, 54, 56, 58, 60. While the various monolithic casting core sections 152, 154, 156, 158, 160, 162, 164 are held in place better than in the prior art due to being part of a monolithic body, some relative movement may still occur during manufacturing. The core positioning features 204 thus further help maintain a positional relationship between the various monolithic casting core sections 152, 154, 156, 158, 160, 162, 164. This, in turn, reduces variation in dimensions of the third wall 16 or ribs 50, 52, 54, 56, 58, 60 and increases part yield.

Figure 23:
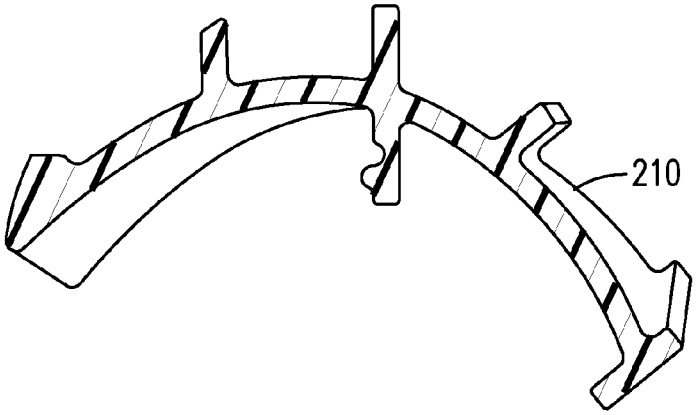
FIG. 23 is a schematic mean-line cross sectional view of an exemplary embodiment of a twisted fugitive core insert.

FIG. 23 is a schematic mean-line cross sectional view of an exemplary embodiment of a twisted fugitive core insert 210. Here again a flexible mold can be readily removed where a rigid mold may become trapped in the twist.

Figure 24:
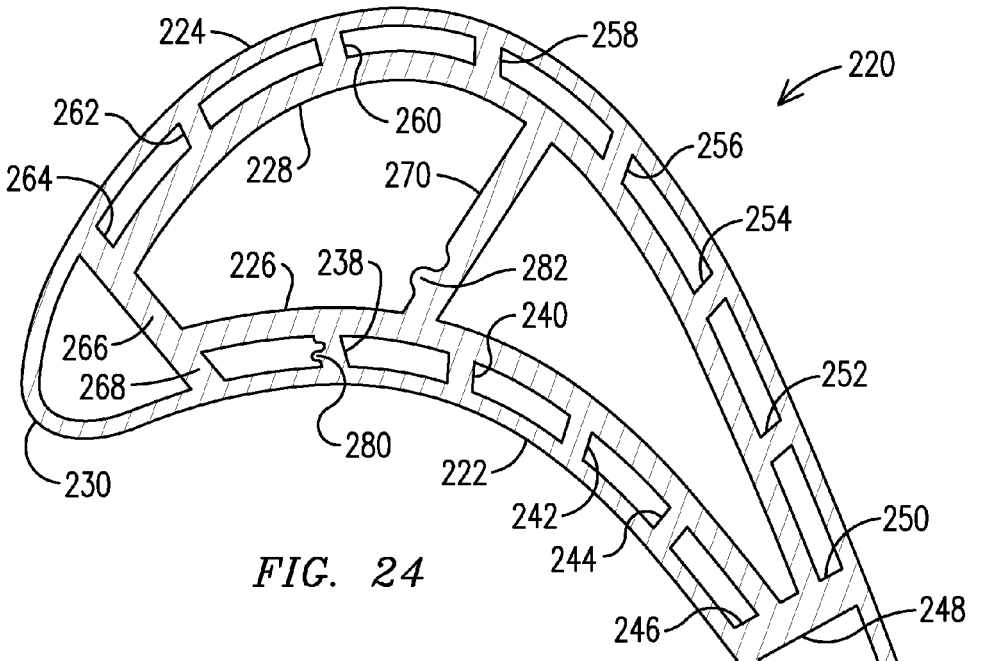
FIG. 24 is a schematic mean-line cross sectional view of an exemplary embodiment of a four-walled airfoil that can be formed using multiple fugitive core inserts.

FIG. 24 is a schematic mean-line cross sectional view of an exemplary embodiment of a four-walled airfoil 220 that can be formed using multiple fugitive core inserts. The four-walled airfoil includes a pressure side wall 222, a suction side wall 224, a third wall 226, a fourth wall 228, a leading edge 230, a trailing edge 232, ribs 238-270. (Ribs 246, 248, 250 and 264, 266, 268 are separately indicated despite being one structure only for purposes of distinguishing sections of the rib structure with respect to the third wall 226 and the fourth wall 228.) Present on rib 238 is a surface feature 280 and present on rib 270 is another surface feature 282. While the surface features 280, 282 are shown on ribs 238 and 270, they can be present on any interior surface of the four-walled airfoil 220.

Figure 25:
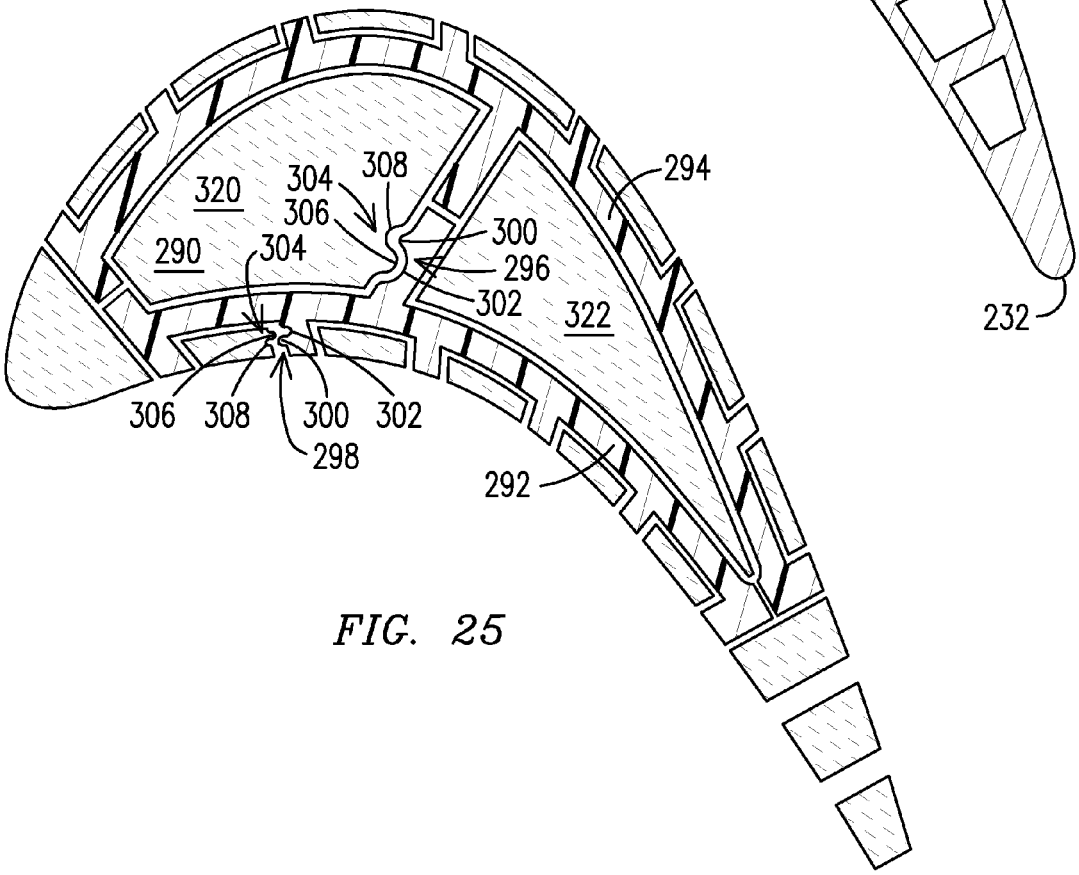
FIG. 25 is a schematic mean-line cross sectional view of an exemplary embodiment of a monolithic casting core and multiple fugitive core inserts used to form the four-walled airfoil of FIG. 24.

FIG. 25 is a schematic mean-line cross sectional view of an exemplary embodiment of a monolithic casting core 290 and multiple fugitive core inserts 292, 294 used to form the four-walled airfoil 220 of FIG. 24. Fugitive core insert 292 is shown having a fugitive core insert rib features 296 and 298 each having a fugitive core insert protrusion 300 and a fugitive core insert depression 302. The fugitive core insert surface features 296, 298 form monolithic casting core surface features 304 each having a monolithic casting core protrusion 306 and a monolithic casting core depression 308. The monolithic casting core surface features 304 form the surface features 280, 282.

It can be seen in this exemplary embodiment that the fugitive core inserts 292, 294 would be locked into place by the interlocking action of the surface features 280, 282 and the monolithic casting core surface features 304 similar to that of the three-walled embodiment described in the discussion of FIG. 9. As a result, prior manufacturing techniques could not produce these surface features in these locations. However, the teaching herein enables the surface features 280, 282 to be so positioned. In addition, in this mean-line cross section the monolithic casting core sections 320, 322 are formed solely via the fugitive core inserts 292, 294.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A monolithic casting core cast during a single pour casting process and configured to define an entire interior surface of a pressure side wall, an entire interior surface of a suction side wall, and an entire pressure side surface and an entire suction side surface of a third wall of a gas turbine engine multi-wall airfoil during an investment casting process, wherein a third-wall void in the casting core forms the third wall and is oriented from a leading edge toward a trailing edge of the airfoil, wherein the monolithic casting core defines a rib gap between adjacent core sections, the rib gap configured to form a rib between two walls of the multi-wall airfoil, and wherein the monolithic casting core comprises core features in the rib gap configured to define surface features on the rib.

2. The monolithic casting core of claim 1, wherein the monolithic casting core is further configured to define an entire pressure side surface and an entire suction side surface of a fourth wall of the multi-wall airfoil, wherein a fourth-wall void in the casting core forms the fourth wall and is oriented from the leading edge toward the trailing edge of the airfoil and from the leading edge toward the trailing edge the fourth-wall void is disposed astride the third-wall void.

3. The monolithic casting core of claim 2, wherein the monolithic casting core further comprises a rib gap between the third-wall void and a fourth-wall void, and core features in the rib gap between the third-wall void and a fourth-wall void configured to define surface features on a rib spanning from the third wall to the fourth wall.

4. The monolithic casting core of claim 1, wherein in a mean-line cross section of the monolithic casting core the surface features form a protrusion from or a recess into the rib.

5. The monolithic casting core of claim 1, further comprising at least two core sections, at least one of the core sections comprising an integral positioning feature protruding there from, the positioning feature being configured to help the two core sections maintain a spatial relationship by bridging a gap between the two core sections.

6. The monolithic casting core of claim 1, further comprising at least two core sections and a positioning feature secured to both core sections and spanning a gap there between.

7. The monolithic casting core of claim 1, wherein the third wall void originates at the leading edge.

* * * * *